United States Patent [19]

Van Mullekom

[11] 4,238,080

[45] Dec. 9, 1980

[54] APPARATUS FOR FORMING A SUPPLY COIL FROM A THREAD SUPPLIED FROM A YARN STOCK

[75] Inventor: Hubert P. Van Mullekom, Deurne, Netherlands

[73] Assignee: Ruti-Te Strake B.V., Deurne, Netherlands

[21] Appl. No.: 22,522

[22] Filed: Mar. 21, 1979

[30] Foreign Application Priority Data

Jun. 15, 1978 [NL] Netherlands ..... 7806469

[51] Int. Cl.[3] ..... B65H 51/20

[52] U.S. Cl. ..... 242/47.12; 242/47.01

[58] Field of Search ..... 242/47.01–47.13; 139/452; 66/132 R

[56] References Cited

U.S. PATENT DOCUMENTS

| | | | |
|---|---|---|---|
| 3,674,057 | 7/1972 | Hosono et al. | 139/452 |
| 3,776,480 | 12/1973 | Lawson | 242/47.12 X |
| 3,955,769 | 5/1976 | Kajiura et al. | 242/47.01 |
| 3,971,522 | 7/1976 | Pfarrwaller | 242/47.12 X |
| 4,056,239 | 11/1977 | Fecker et al. | 242/47.01 |
| 4,090,677 | 5/1978 | Savio et al. | 242/47.01 |

FOREIGN PATENT DOCUMENTS

| | | | |
|---|---|---|---|
| 123403 | 6/1967 | Czechoslovakia | 242/47.12 |

*Primary Examiner*—Stanley N. Gilreath
*Attorney, Agent, or Firm*—Marshall & Yeasting

[57] ABSTRACT

Apparatus for forming a supply coil from a thread supplied from a yarn stock, said apparatus comprising a stationary winding drum and a thread guide which is rotatable with respect to the drum, said drum having an adjustable circumference and being provided with means for moving axially along the drum the supply coil formed thereon, whereby the winding drum is composed of a radially fixed part, in which the means for axially moving the formed supply coil are received, and of a radially adjustable part.

2 Claims, 2 Drawing Figures

APPARATUS FOR FORMING A SUPPLY COIL FROM A THREAD SUPPLIED FROM A YARN STOCK

Figure 1:
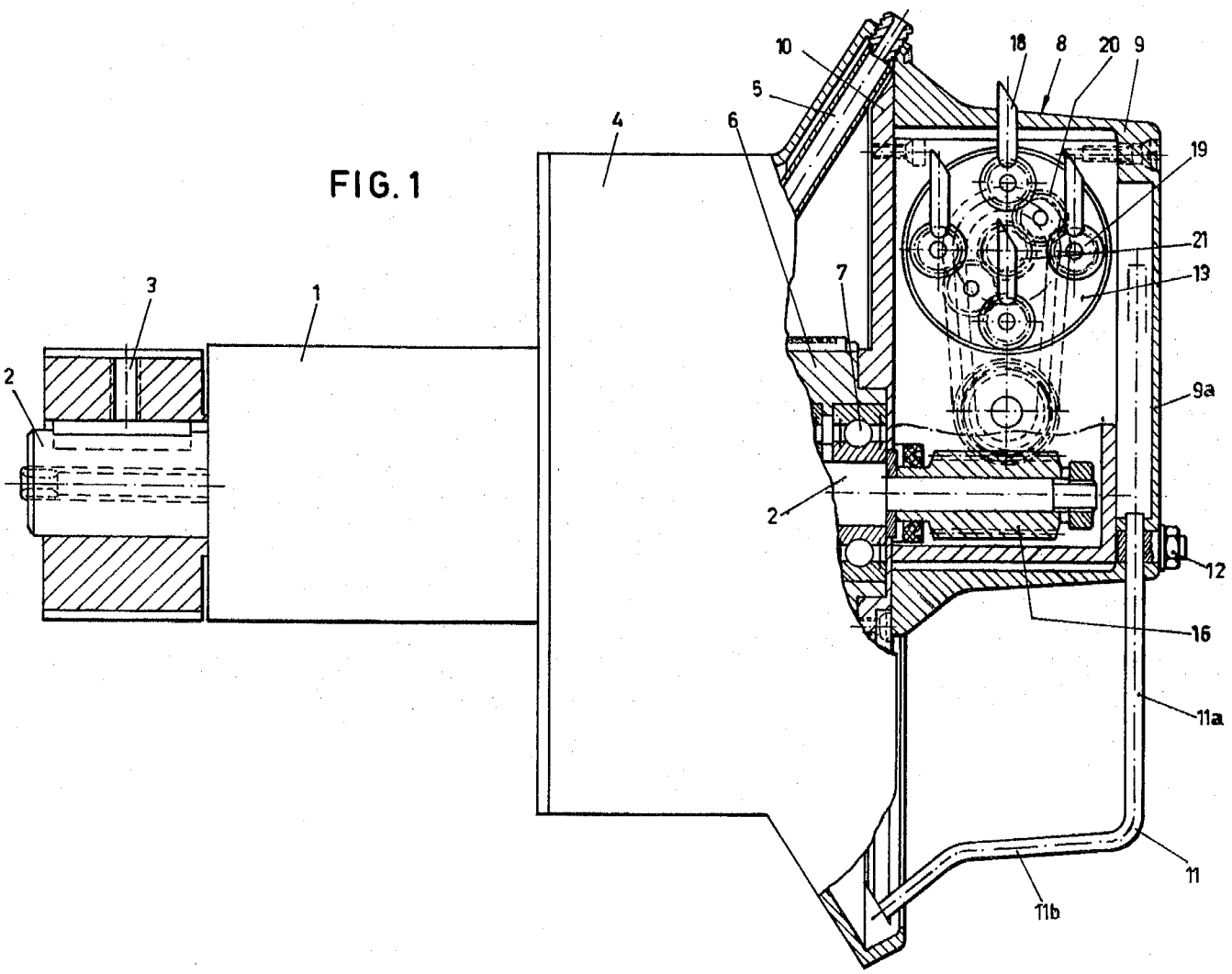

The invention relates to an apparatus for forming a supply coil from a thread supplied from a yarn stock, said apparatus comprising a stationary winding drum and a thread guide rotatable with respect thereto, said winding drum having an adjustable circumference and being provided with means for moving along the drum in axial direction the supply coil formed thereon.

Such an apparatus is e.g. known from the U.S. Pat. No. 3,674,057. In this known apparatus the winding drum is constituted by a series of endless belts positioned according to the generatrices of a cylinder. The outer runs of said endless belts constitute together the winding surface of the drum. During operation said endless belts are driven such that the yarn coil formed on the drum surface is moved in axial direction.

Adjusting the drum circumference and therefore the total length of the yarn coil to be formed on the drum is herein achieved by placing the endless belts at a larger or smaller distance from the axis of the apparatus. This means a change of position of the point from which the formed yarn coil is drawn from the drum.

The invention aims at providing a construction in which the supply coil is always, regardless of the chosen drum circumference, drawn from the same position in order to be transferred to the yarn using apparatus, e.g. the weft transport means of a pneumatic weaving machine.

According to the invention the winding drum is therefore composed from a radially fixed part, in which the means for axially moving the formed supply coil are provided, and from a radially adjustable part.

The drawing from the drum of the yarn coil formed thereon therefore always takes place from the radially fixed part of the winding drum, whereas the radial position of the adjustable part may be chosen dependant on the desired total yarn coil length.

According to a further feature of the invention the radially adjustable part comprises at least one axially directed rib which is adjustably mounted in radial direction from the winding surface of the fixed part.

With the application of one single rib a radial shifting thereof will result in a relatively small change of the effective circumference length of the winding drum and therefore in a relatively small change of the total supply coil length. If applied as weft preparation apparatus in a weaving machine having a predetermined weaving width thereby the total supply coil length may be adapted very accurately with respect to the weaving width. This means that the percentage of the weft yarn length which necessarily has to be cut at the end of the weft phase as debris can be kept as small as possible.

If more ribs are applied the total supply coil length of course is adjustable within broader limits so that it may be adapted to e.g. different weaving widths of a weaving machine.

In a practical embodiment the radially fixed part of the drum is constituted by a generally cylindrical housing mounted excentrically with respect to the winding arm axis, while the radially adjustable drum part is constituted by a number of ribs shaped as substantially L-shaped bent parts, each directed radially with one leg and radially adjustable connected to the cylindrical housing and a directed axially with the other leg, according to the generatrices of the winding drum.

The invention is hereunder illustrated with reference to the drawing of an embodiment.

Figure 2:
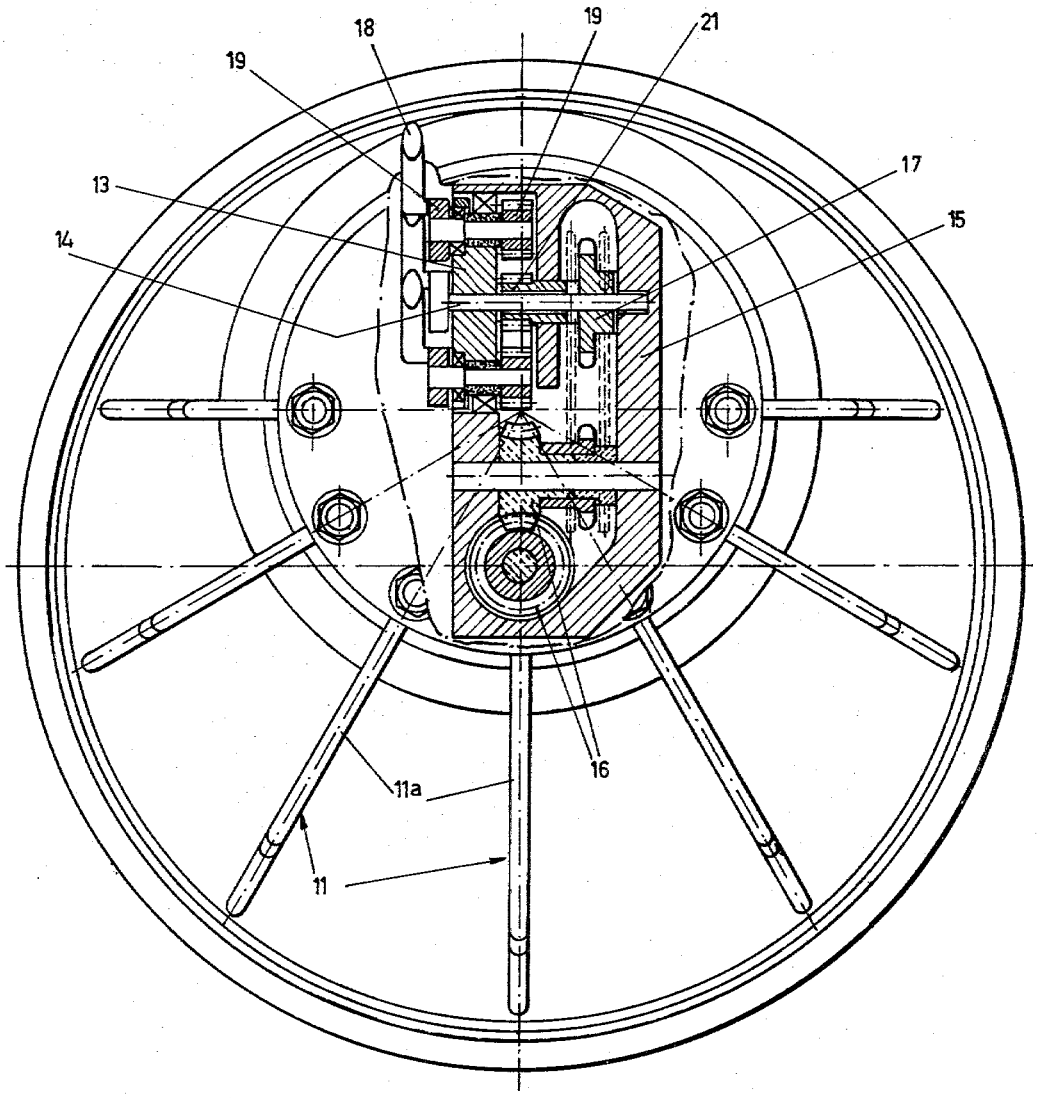

FIG. 1 is a side view, partially in longitudinal section, of the apparatus according to the invention and FIG. 2 is an end view, as seen from the right in FIG. 1.

The apparatus shown in the drawing has a sleevelike support member 1 through which the apparatus may be connected to the frame of a yarn using machine, particularly a shuttleless weaving machine. In this sleevelike support member 1 a shaft 2 is rotatably mounted through a number of ball bearings not shown in the drawing. The shaft 2 carries at its end extending in FIG. 1 to the left beyond the support member 1 a pinion 3 which is drivable through a suitable transmissin by a control shaft (not further shown) of the yarn using machine. The reference number 4 indicates a housing secured to the shaft 2 which therefore is rotatable with respect to the stationary support member 1 and a.o. supports the winding arm constituted by a tube 5.

Reference number 6 indicates a cylindrical hub portion which is journalled on the shaft 2 through the intermediary of a ball bearings 7 and is coupled through a transmission mechanism (not further shown) within the housing 4 with the support member 1 such that it remains stationary when the shaft 2 rotates.

Reference number 8 indicates the yarn winding drum. Said winding drum comprises a substantially cylindrical housing 9 which at its right hand end is closed by an end wall **9*a* and with its left hand open end is secured against a disc 10 carried by the hub portion 6. The drum housing 9 has an excentric position with respect to the shaft 2 and remains stationary due to its connection with the hub portion 6 when the shaft rotates. The housing 9 is provided along part of its circumference, in the embodiment shown along the circumference half being closest to the axis of the shaft 2, with a number of elements 11 bent substantially to L shape. The elements 11 are each received radially adjustable with one leg 11*a* in a radial bore in the relative circumferential wall portion of the housing 9 and may be fixed by means of a clamping sleeve 12. The other legs 11*b* of the L-shaped elements are formed and directed corresponding to the generatrices of the substantially cylindrical housing 9. The legs 11*b* thereby form together with the generatrix of the housing 9 which is most remote from the shaft 2** the winding surface of the drum.

It will be clear that by radially adjusting the L-shaped elements the effective diameter of the winding drum may be increased or decreased corresponding to the desired yarn length of the yarn coil formed by the winding arm 5 on the drum.

In FIG. 2 the L-shaped elements are shown in their radially extreme positions in which the legs **11*b* and the upper generatrix of the housing 9 delimite a winding surface which is coaxial with respect to the shaft 2**.

Within the space enclosed by the housing 9 there is a disc 13 which is rotatable around a shaft 14 perpendicular to the shaft 2 and mounted in a support block 15 secured within the housing 4. The disc 13 is thereby driven by the shaft 2 through a worm gear transmission 16 and a belt or chain drive 17. The disc 13 carries four pins 18 equally spaced around its circumference, which pins extend radially from pinions 19 journalled on the disc 13, said pinions engaging through intermediary gears 20 a central pinion 21 which is rotatable with respect to the disc 8 in a ratio such that the pins 18 carry out a translation movement when the disc 13 rotates. The pins 18 assume a substantially radial position with respect to the winding drum and during operation, so with rotating winding arm 5 and rotating disc 13, successively leave the housing through an axial slot in the circumferential wall of the housing 9, extending substantially along the upper generatrix of the housing 9, in order to engage the yarn windings produced by the winding arm 5 on the winding drum and move them axially, as seen in the drawing towards the right side.

The mechanism with the pins 18 is of a type known per se, namely of the type as described in U.S. Pat. No. 4,132,370, issued Jan. 2, 1979.

I claim:

1. Apparatus for forming a supply coil from a thread supplied from a yarn stock, said apparatus comprising a stationary yarn winding drum having a radially fixed part with a winding surface and a radially adjustable part with a winding surface, winding arm means rotatable with respect to the drum for forming a yarn coil on the drum, and pin means within the drum engaging the windings of the formed yarn coil on the drum to move the yarn coil axially along the drum, the radially adjustable part of the drum including means for adjusting the effective diameter of the drum corresponding to the desired yarn length of the yarn coil formed by the winding arm means on the drum, wherein the radially adjustable part comprises at least one axially directed rib, which is mounted radially adjustable from the winding surface of the fixed part, and wherein the fixed part of the drum is constituted by a substantially cylindrical housing which is arranged excentrically with respect to the axis of the winding arm means, whereas the radially adjustable drum part is constituted by a number of ribs shaped as parts bent substantially to L-shape which each are radially directed with one leg and are connected to the cylindrical housing adjustable in radial direction and with the other leg are directed axially according to the generatrices of the winding drum.

2. Apparatus for forming a supply coil from a thread supplied from a yarn stock, said apparatus comprising a stationary yarn winding drum having a radially fixed part with a winding surface and a radially adjustable part with a winding surface, winding arm means rotatable with respect to the drum for forming a yarn coil on the drum, and pin means within the drum engaging the windings of the formed yarn coil on the drum to move the yarn coil axially along the drum, the radially adjustable part of the drum including means for adjusting the effective diameter of the drum corresponding to the desired yarn length of the yarn coil formed by the winding arm means on the drum, wherein the fixed part of the drum is constituted by a substantially cylindrical housing which is arranged excentrically with respect to the axis of the winding arm means, whereas the radially adjustable drum part is constituted by a number of ribs shaped as parts bent substantially to L-shape which each are radially directed with one leg and are connected to the cylindrical housing adjustable in radial direction and with the other leg are directed axially according to the generatrices of the winding drum.

* * * * *